US008911282B2

(12) United States Patent
Mulder et al.

(10) Patent No.: US 8,911,282 B2
(45) Date of Patent: Dec. 16, 2014

(54) APPARATUS WITH VARIABLE FIXTURING ARMS FOR ABRASIVE ENVIRONMENT

(75) Inventors: Gary E. Mulder, Grand Rapids, MI (US); Gary L. Vander Stel, Caledonia, MI (US)

(73) Assignee: Progressive Surface, Inc., Grand Rapids, MI (US)

( * ) Notice: Subject to any disclaimer, the term of this patent is extended or adjusted under 35 U.S.C. 154(b) by 344 days.

(21) Appl. No.: 13/307,373

(22) Filed: Nov. 30, 2011

(65) Prior Publication Data

US 2012/0156966 A1 Jun. 21, 2012

Related U.S. Application Data

(60) Provisional application No. 61/425,017, filed on Dec. 20, 2010.

(51) Int. Cl.
*B24B 5/307* (2006.01)
*B05B 13/02* (2006.01)

(52) U.S. Cl.
CPC ..... *B05B 13/0285* (2013.01); *B05B 13/0228* (2013.01)
USPC ..... 451/365; 269/55; 269/60; 269/71

(58) Field of Classification Search
CPC .... C23C 14/505; G10M 13/04; G10M 13/05; Y10S 269/90; B23P 19/00; B23Q 6/02; B23Q 1/05; B25J 17/0208; B25J 17/0266; B25J 17/0275; B25J 9/107; F16M 11/43; F16M 11/12; F16M 11/125
USPC ..... 451/365; 269/55, 60, 71
See application file for complete search history.

(56) References Cited

U.S. PATENT DOCUMENTS

| | | | | |
|---|---|---|---|---|
| 2,493,872 | A * | 1/1950 | Henry | 73/483 |
| 4,070,915 | A * | 1/1978 | Caroff | 73/487 |
| 4,167,118 | A * | 9/1979 | Hihara | 73/487 |
| 4,530,239 | A * | 7/1985 | Scarinci | 73/455 |
| 5,300,006 | A * | 4/1994 | Tanaka et al. | 483/56 |
| 5,932,026 | A * | 8/1999 | Trampusch | 134/7 |
| 6,431,535 | B1 * | 8/2002 | Volpe | 269/47 |
| 6,454,857 | B1 * | 9/2002 | Glasner et al. | 118/306 |
| 7,891,646 | B2 * | 2/2011 | Terry | 269/41 |
| 8,079,580 | B2 * | 12/2011 | Ohnesorge et al. | 269/57 |
| 8,444,126 | B2 * | 5/2013 | Siebert et al. | 269/21 |

* cited by examiner

*Primary Examiner* — Maurina Rachuba
(74) *Attorney, Agent, or Firm* — Price Heneveld LLP

(57) ABSTRACT

An apparatus includes a base, a table rotatable on the base, and a plurality of arms extending above the table's top surface and extending laterally for supporting differently sized cylindrical objects above the top surface. An adjustment mechanism simultaneously adjusts the arms rotationally, such that the ends of the arms can be automatically adjusted to support any one of the differently sized objects without further change. A controller is programmed to automatically control the adjustment mechanism. The adjustment mechanism includes a center gear connected to planetary gears on each of the arms, and a center shaft that extends upwardly through a tubular drive shaft, the center shaft being movable between a lowered position where the arms are locked to the table and a raised position where the center gear is fixed to the base such that the arms adjust position when the table is rotated by its drive mechanism.

23 Claims, 11 Drawing Sheets

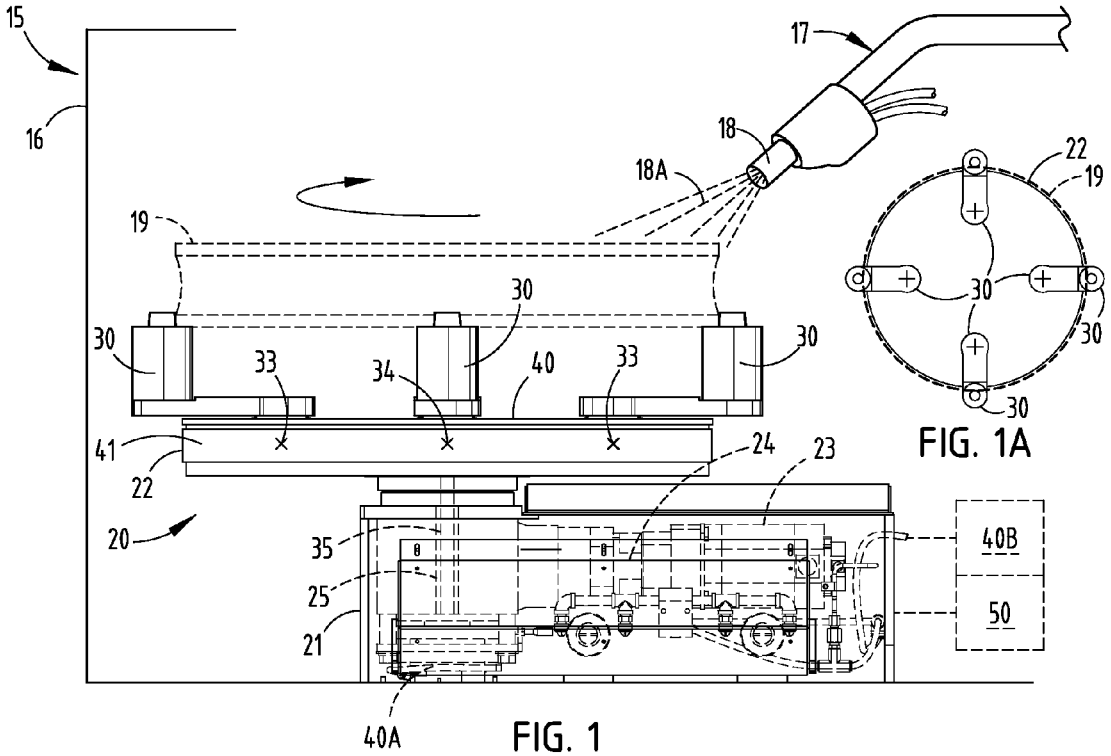
FIG. 1A
FIG. 1
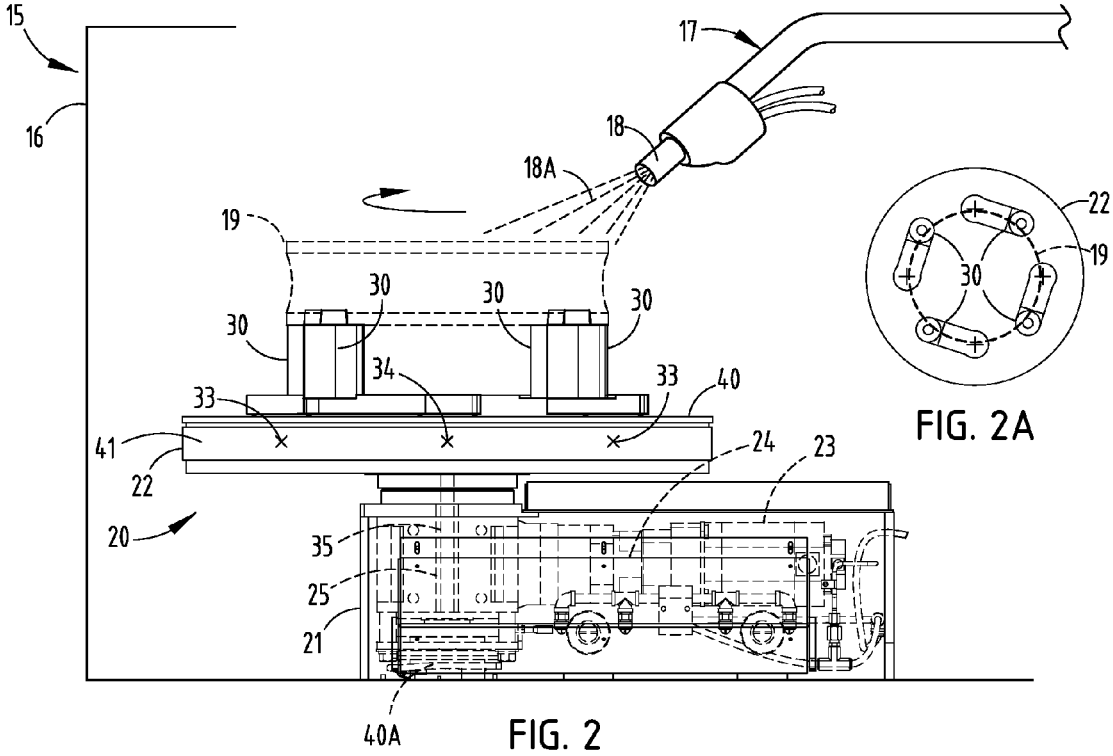
FIG. 2A
FIG. 2

APPARATUS WITH VARIABLE FIXTURING ARMS FOR ABRASIVE ENVIRONMENT

CROSS REFERENCE TO RELATED APPLICATION

This application claims benefit under 35 USC §119(e) of provisional application Ser. No. 61/425,017, filed Dec. 20, 2010, entitled APPARATUS WITH VARIABLE FIXTURING ARMS FOR ABRASIVE ENVIRONMENT, the entire contents of which are incorporated herein by reference.

BACKGROUND

The present invention relates to an apparatus for selectively supporting differently sized objects while treating or inspecting a surface of a selected one of the objects, such as with an abrasive media or bead media for surface finishing or cleaning applications or water media for pressurized water surface finishing or cleaning applications or coating operations for surfaces.

Rotatable tables are often used when treating a surface of a part with an abrasive media, such as shot peening media, blasting media, and the like, in order to achieve a desired surface treatment. Historically, a holding fixture is placed on the table that is adapted to hold a particular part. When there are several short runs, a first holding fixture is used for parts of one size, and then it is repeatedly replaced as differently sized parts are brought to be treated. For example, this often happens when treating wheels of different sizes. However, it is disruptive to the overall process when a part-specific fixture must be exchanged, since the process enclosure must be repeatedly entered, and also since fixtures must be repeatedly put into position and then later carried away and replaced. This adds undesirably to manual labor costs and also adds to capital expenditure when part-specific fixtures are used.

SUMMARY OF THE PRESENT INVENTION

In one aspect of the present invention, an apparatus for supporting differently sized objects while treating or inspecting a surface of a selected one of the objects, comprises a base, a table rotatable on the base and having a top surface, and a plurality of arm assemblies extending above the top surface and extending laterally, the arm assemblies each having a holder adapted to support any one of the differently sized objects above the top surface. The apparatus further includes an adjustment mechanism for adjusting the arm assemblies rotationally to change relative positions of the holders equal amounts relative to a center area on the table, such that the holders of the arm assemblies can be automatically adjusted to support any one of the differently sized objects without further change.

In a narrower form, a controller may be provided to automatically control the adjustment mechanism.

In another aspect of the present invention, an apparatus for supporting differently sized objects while treating or inspecting a surface of a selected one of the objects includes a base, a table rotatable on the base and having a top surface, a drive for rotating the table, and a plurality of arm assemblies extending above the top surface and extending laterally, the arm assemblies each being adapted to support any one of the differently sized objects above the top surface. An adjustment mechanism is provided for automatically adjusting the arm assemblies to change positions relative to a center area on the table, the adjustment mechanism selectively engaging the drive to cause adjustment and selectively disengaging the drive to fix an adjusted location of the arm assemblies on the table.

In another aspect of the present invention, an apparatus for supporting differently sized objects while treating or inspecting a surface of a selected one of the objects includes a base, a table rotatable on the base and having a top surface, a plurality of arm assemblies each having a hub extending above the top surface and having an arm portion extending laterally, the arm assemblies each being adapted to support any one of the differently sized objects above the top surface. An adjustment mechanism is provided for automatically adjusting the arm assemblies to change relative positions of the arm assemblies relative to a center area on the table, the adjustment mechanism including a central gear and each arm assembly including a planetary gear engaging the central gear, the adjustment mechanism further including a power-driven device for rotating at least one of the planetary gears and the central gear to cause adjustment of the arm assemblies to adjust locations of the arm assemblies.

In another aspect of the present invention, an apparatus for supporting differently sized objects while treating or inspecting a surface of a selected one of the objects, comprises a base, a table rotatable on the base and having a top surface, a tubular drive shaft for rotating the table, a plurality of arm assemblies pivotally supported by hubs and extending above the top surface and extending laterally, the arm assemblies each having an end spaced horizontally from the associated hub and adapted to support any one of the differently sized objects above the top surface. An adjustment mechanism is provided for automatically rotatably adjusting the arm assemblies to change relative positions of the ends relative to a center area on the table, the adjustment mechanism including an internal shaft extending through the tubular drive shaft which is attached to the aforementioned central gear that, when operating in normal table rotating mode is held to the table, but when operated, decouples from the table and holds with a certain holding force to the base, so that movement of the table selectively causes rotational adjustment of the hubs and hence adjustment of the ends of the arm assemblies.

In another aspect of the present invention, a method is provided for supporting differently sized objects while treating or inspecting a surface of a selected one of the objects, where the differently sized objects include a first part with first diameter and a second part with a different second diameter. The method includes providing a base, a table rotatable on the base and having a top surface, and a drive for rotating the table, providing on the table a plurality of arm assemblies extending above the top surface and extending laterally, the arm assemblies each being adapted to support any one of the differently sized objects above the top surface, and abrasively treating a surface of the first part and after treatment, removing the first part from the ends. The method further includes automatically returning the arms to a known starting point by programming a rotation of the arms beyond the travel range and into the hard stop end of travel, and causing the holding mechanism to slip as designed and needed, leaving the arms at the desired starting home point before each subsequent new position. This is useful because the single drive used for both table rotation and arm adjustment must be coupled and decoupled to the arms over and over, causing small positioning errors to accumulate over time, which would leave the arm positions unknown.

In another aspect of the present invention, an apparatus for treating or inspecting parts includes a fixture having a rotatable table and at least two adjustable arms on the table, a single drive mechanism, and an adjustment mechanism having a first position where the single drive mechanism is engaged to rotate the table and having a second position where the single drive mechanism adjusts the arms.

In another aspect of the present invention, an apparatus for treating or inspecting parts includes a fixture having a movable table and at least two adjustable arms on the table, the arms having part-holding surfaces configured to securely hold a part while the part is one of treated or inspected, a drive mechanism for moving the table, and an adjustment mechanism including a lift mechanism for releasing the arm assemblies for adjustment and a brake mechanism for holding the table while the arm assemblies are adjusted.

In another aspect of the present invention, a method is provided for supporting differently sized objects while treating or inspecting a surface of a selected one of the objects, where the differently sized objects include a first part with first diameter and a second part with a different second diameter. The method includes providing a base, a table rotatable on the base and having a top surface, and a drive for rotating the table, providing on the table a plurality of arm assemblies extending above the top surface and extending laterally, the arm assemblies each being adapted to support any one of the differently sized objects above the top surface. The method includes conducting an operation including one of treating or inspecting a surface of a first part and after the operation, and removing the first part from the arm assemblies. The method further includes automatically adjusting the arm assemblies rotationally to change relative positions of the ends equal amounts relative to a center area on the table for supporting a second part, and then conducting the operation on a surface of the second part and after the operation, removing the second part from the arm assemblies.

In another aspect of the present invention, an apparatus is provided for supporting differently sized cylindrical objects while treating or inspecting a surface of a selected one of the objects media. The apparatus includes an enclosure and a processing gun in the enclosure for treating or inspecting a selected one of the cylindrical objects, a rotatable table, and a plurality of adjustable arm assemblies attached to the table and adapted to support any one of the differently sized objects above the top surface. The apparatus further includes an adjustment mechanism including a programmed controller for automatically adjusting the arm assemblies on the table, such that the arm assemblies are automatically adjusted to support a next one of the differently sized objects.

An object of the present invention is to more fully (or fully) automate the process including addressing the need to change fixtures to hold different parts.

These and other aspects, objects, and features of the present invention will be understood and appreciated by those skilled in the art upon studying the following specification, claims, and appended drawings.

BRIEF DESCRIPTION OF DRAWINGS

FIGS. 1-2 are side views of an enclosure including an apparatus with rotatable table and adjustable arm assemblies with ends adapted for supporting differently sized parts as their surfaces are treated with an abrasive media, and FIGS. 1A-2A are top views of the tables and arms in FIGS. 1-2, respectively.

FIG. 8A is a fragmentary view similar to an upper left corner of FIG. 8 showing the fixture arm adjusting mechanism while

DETAILED DESCRIPTION OF PREFERRED EMBODIMENTS

Figure 3:
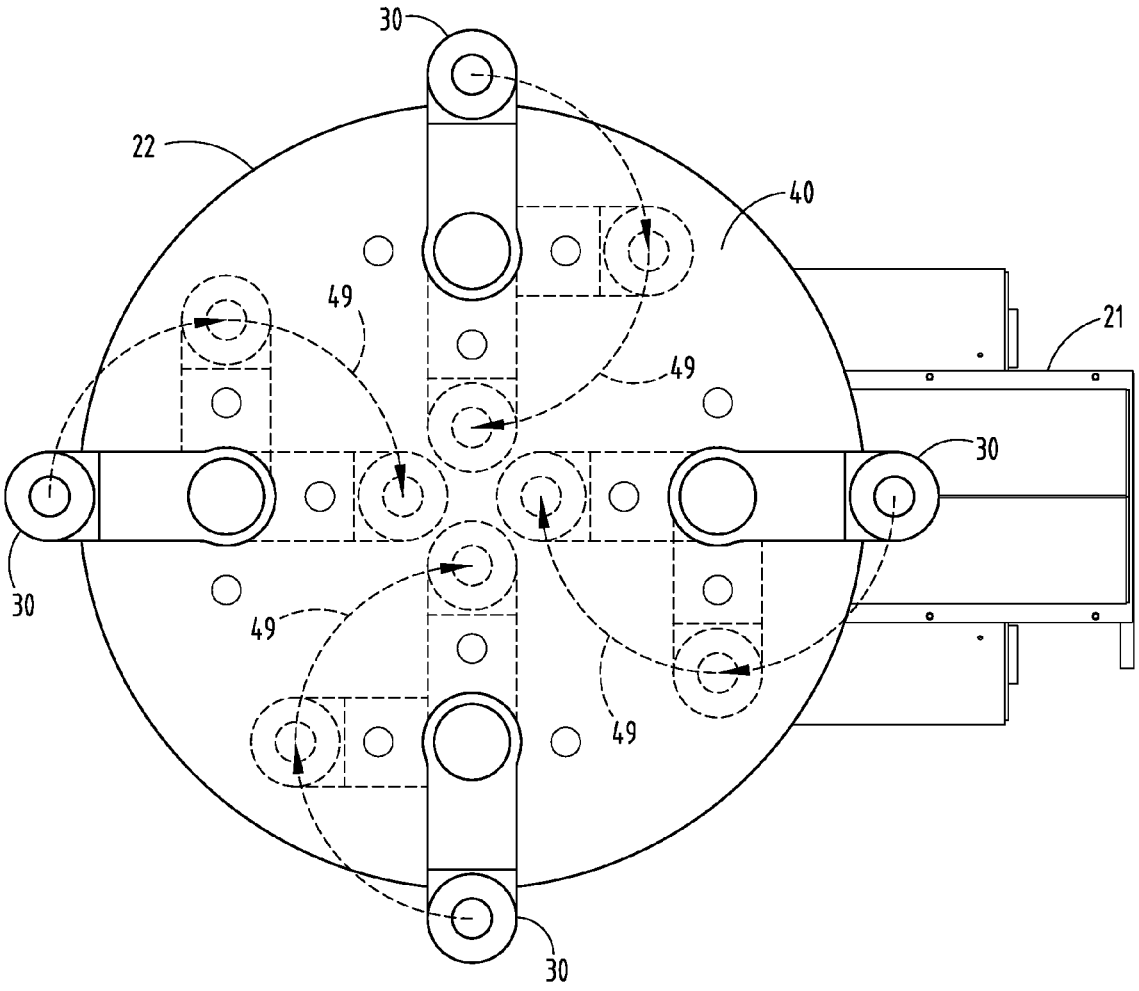
FIG. 3 is an enlarged top view similar to FIG. 1A.
Figure 3A:
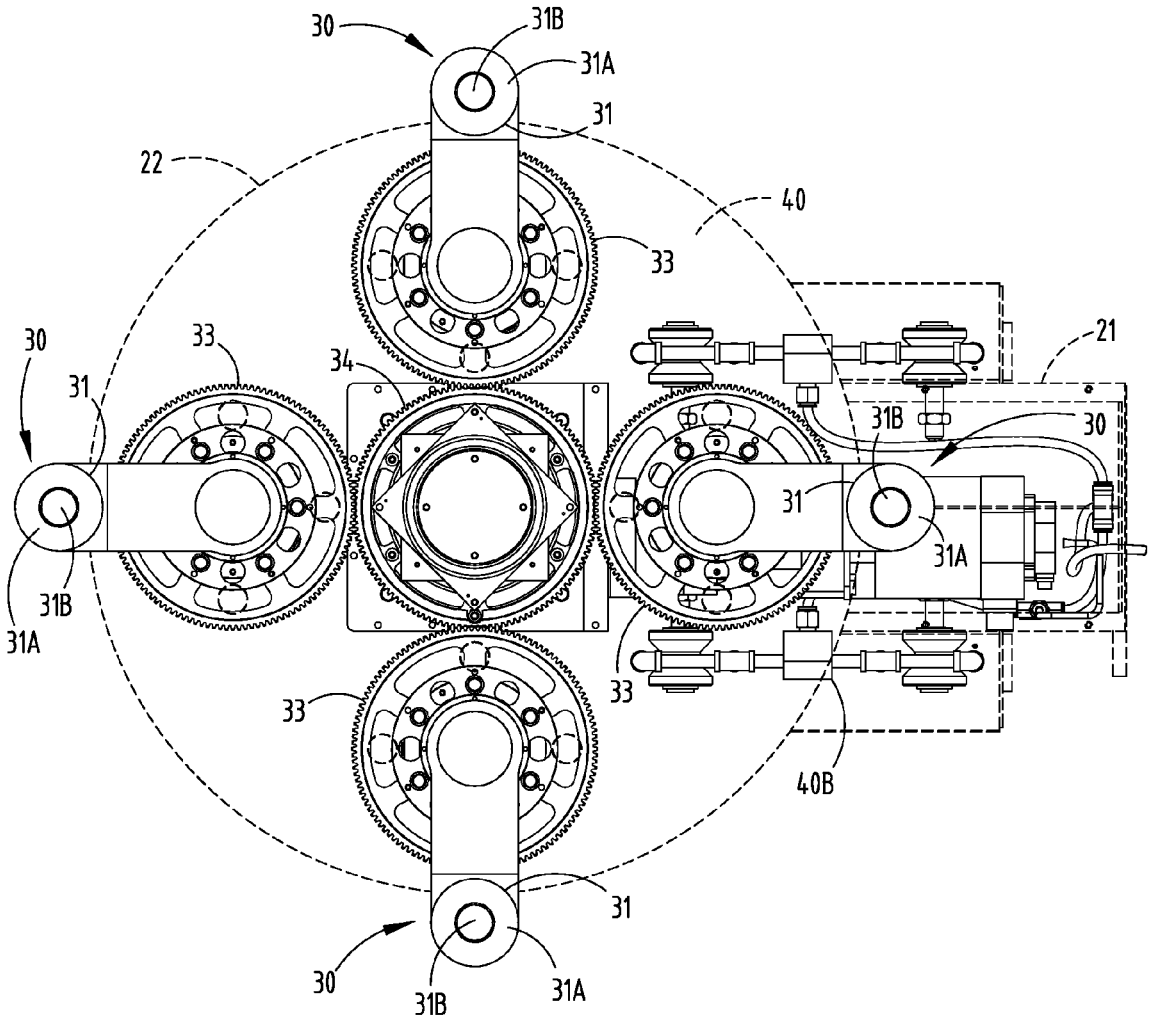
FIG. 3A is a view similar to FIG. 3 but with the table top removed to show structure under the table top.

The present apparatus 15 (FIG. 1) includes an enclosure 16 housing a robot 17 (or adjustable gun-supporting arm), a robot-supported surface-treatment gun 18 (also called a "processing device" herein) for applying surface-treating material (or for inspecting a surface), and a production cylindrical part 19 supported on an apparatus 20. The first part 19 is supported and rotated by apparatus 20 while the gun 18 applies surface-treating media 18A and while the gun 18 is manipulated/articulated by the robot 17. The enclosure contains and collects the media 18A during the surface treatment operation. Advantageously, the apparatus 20 includes adjustable part-holding components that are adapted to not only hold the illustrated part 19 during the abrasive/harsh surface treatment operation, but also the part-holding components are automatically infinitely adjustable to hold differently sized parts such as the illustrated differently sized part 19A (FIG. 2). It is intended that the term "gun" as used herein be broadly interpreted as a processing gun or device.

The present adjustable part-holding apparatus and components provide several advantages. For example, the components eliminate the need for several different part-specific fixturing/holding components and part-holding fixtures. They further eliminate the need for an operator to shut down the apparatus and enter the enclosure 16 to replace a particular part-holding fixture with another one. They also eliminate the need for an operator to manually operate or actuate an adjustment mechanism. Still further, the present apparatus 20 allows a single drive mechanism to both rotate the table (including a fixtured first part), and also separately cause automatic adjustment of the part-supporting components to a new location for supporting a different diameter part. Still further, the present apparatus uses few parts and relatively non-complex parts that are durable and long-lasting despite the harsh environment of the enclosed surface treatment system. It is contemplated that the present apparatus 20 can be used as flexible fixturing in a wide range of applications, such as treating part surfaces with shot peen, blasting, paint, water, slurry, thermospray coating, etc. It is further contemplated that the present apparatus can be used in inspection and quality control operations, as well as in any circumstance where fully automated but flexible fixturing is required for holding parts of different shapes and sizes both accurately and securely.

Figure 4:
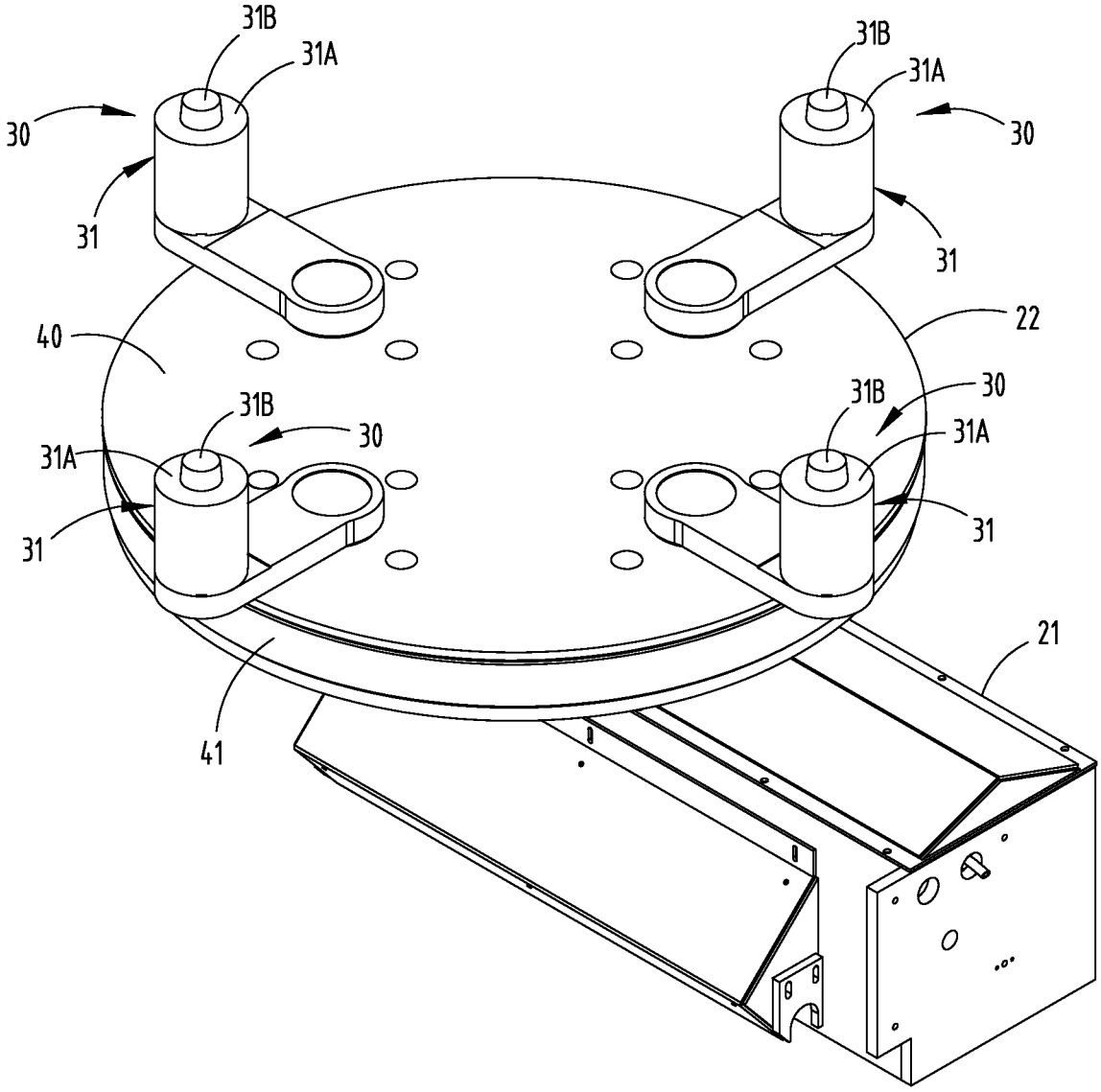
FIGS. 4-4A are perspective views similar to FIGS. 3 and 3A, respectively.
Figure 4A:
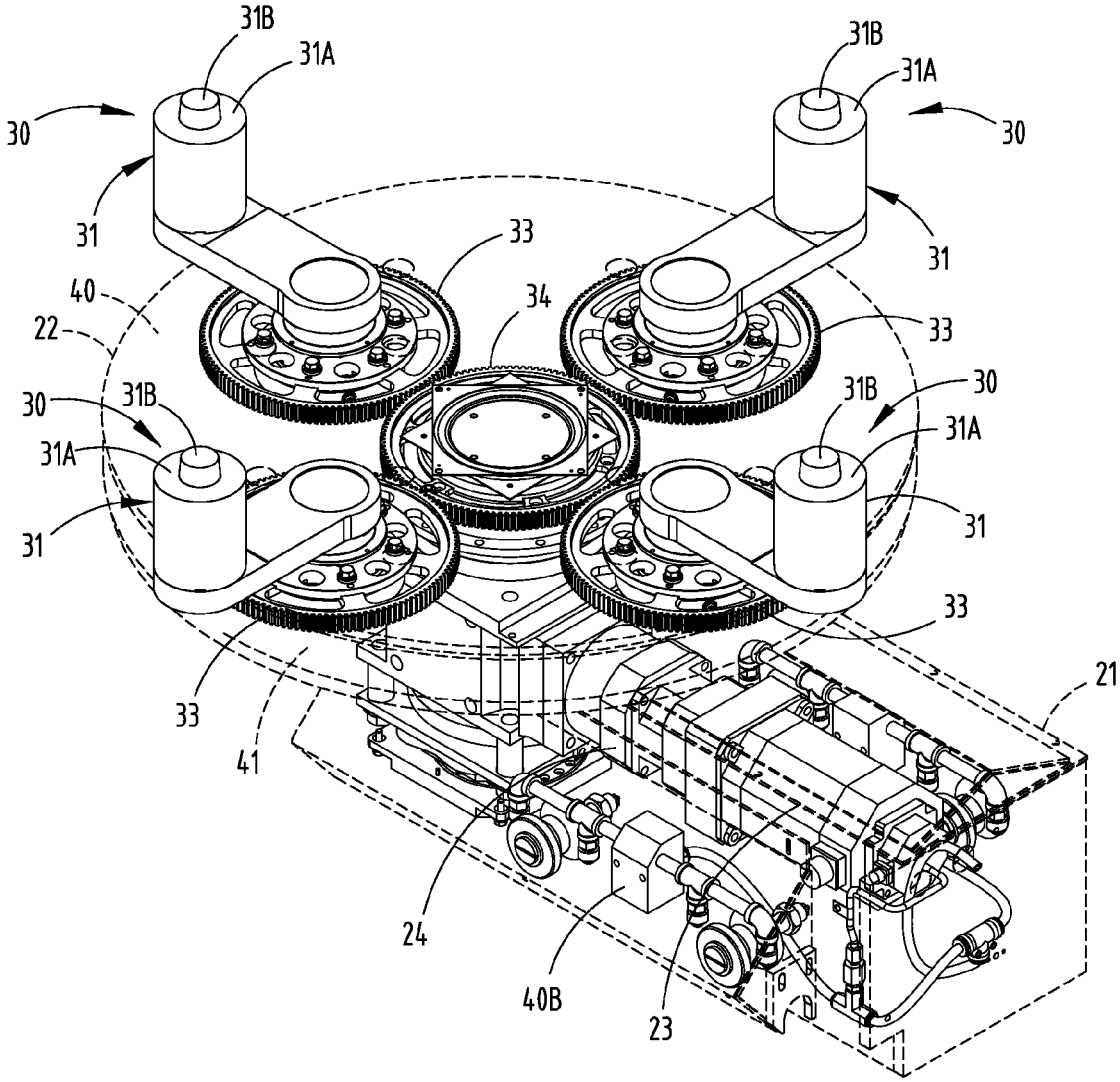
Figure 5:
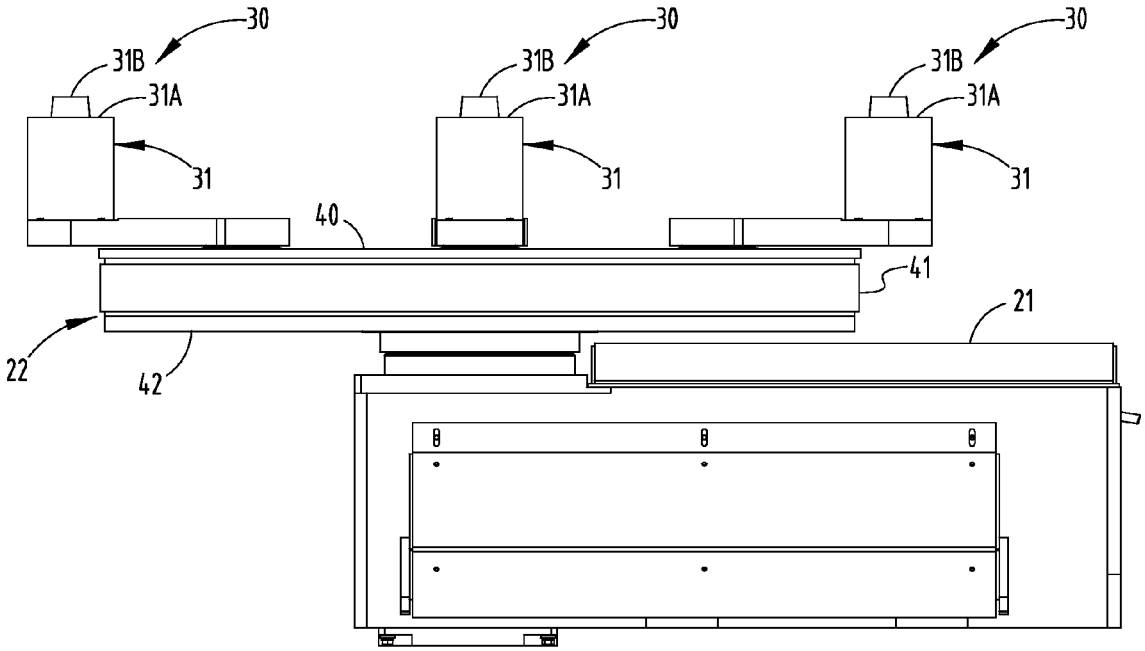
FIGS. 5-5A are side views of FIGS. 6 and 6A, respectively.
Figure 5A:
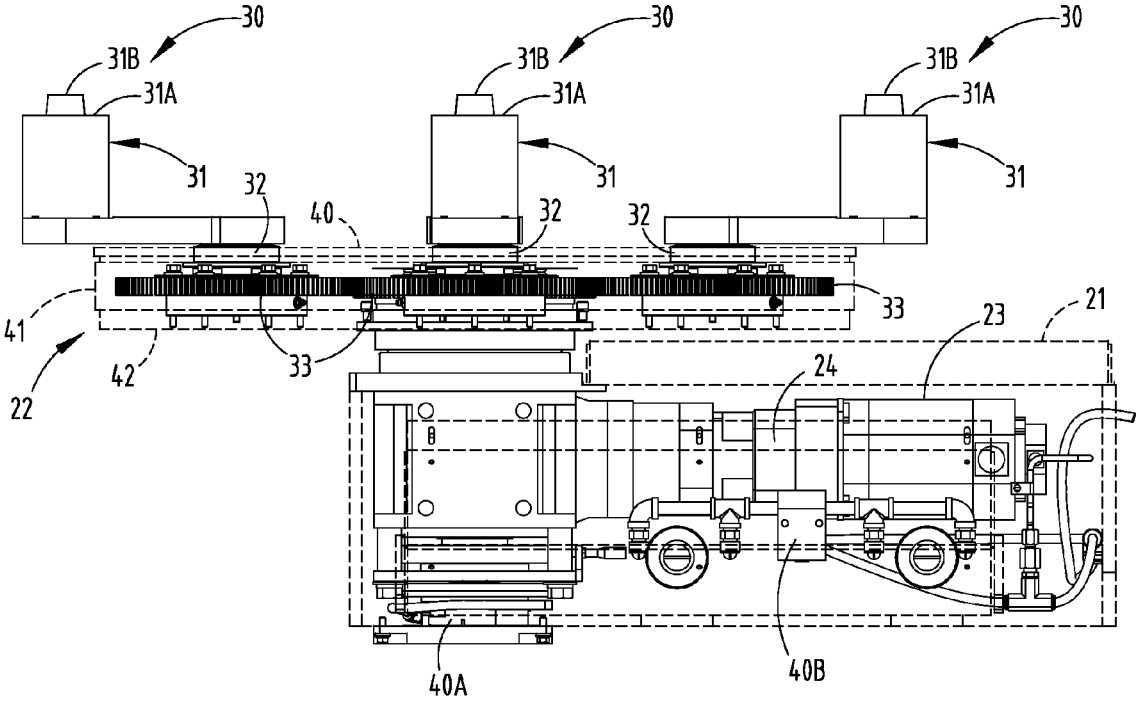
Figure 6:
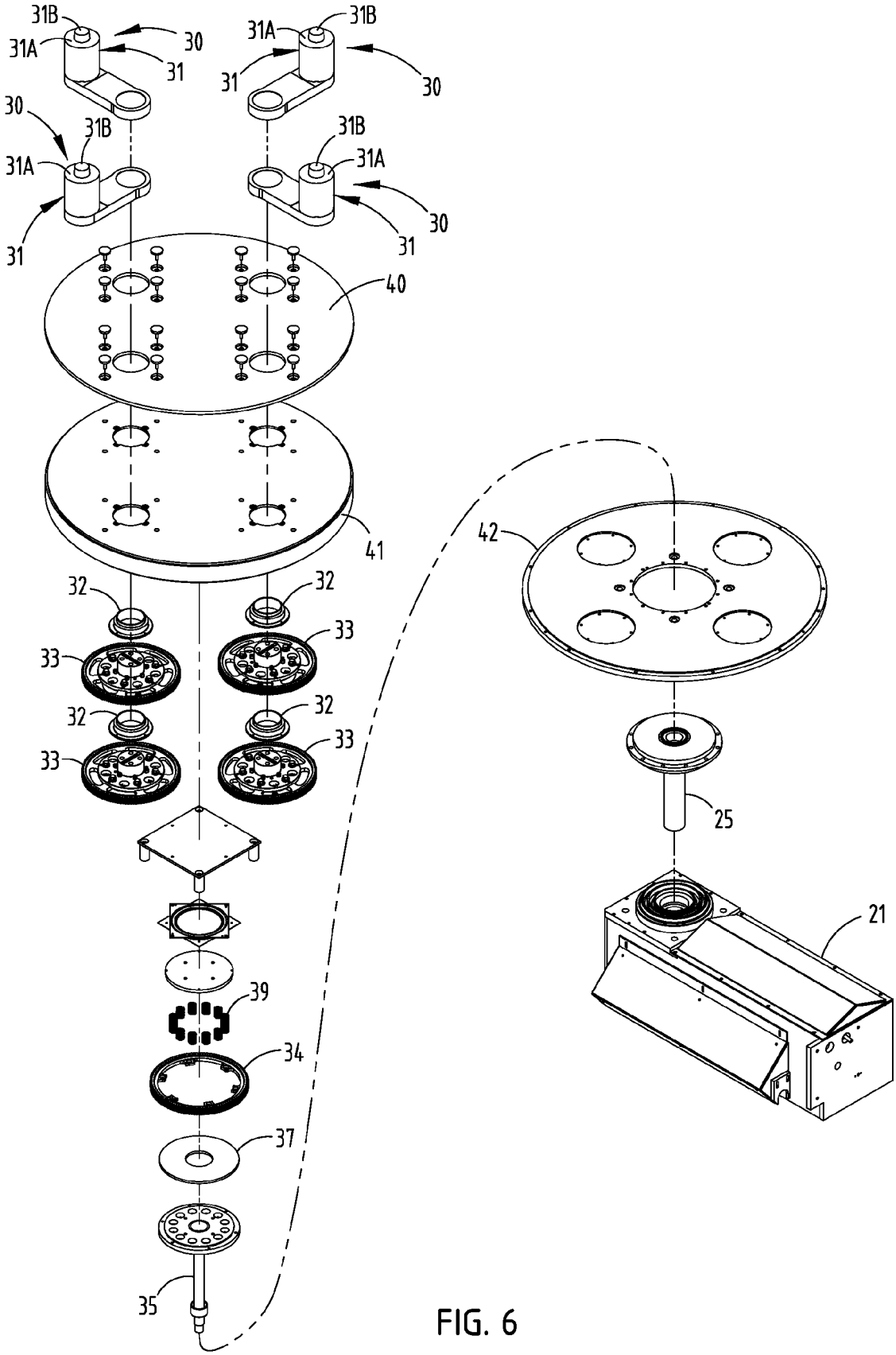
FIG. 6 is an exploded view of FIG. 6.
Figure 7:
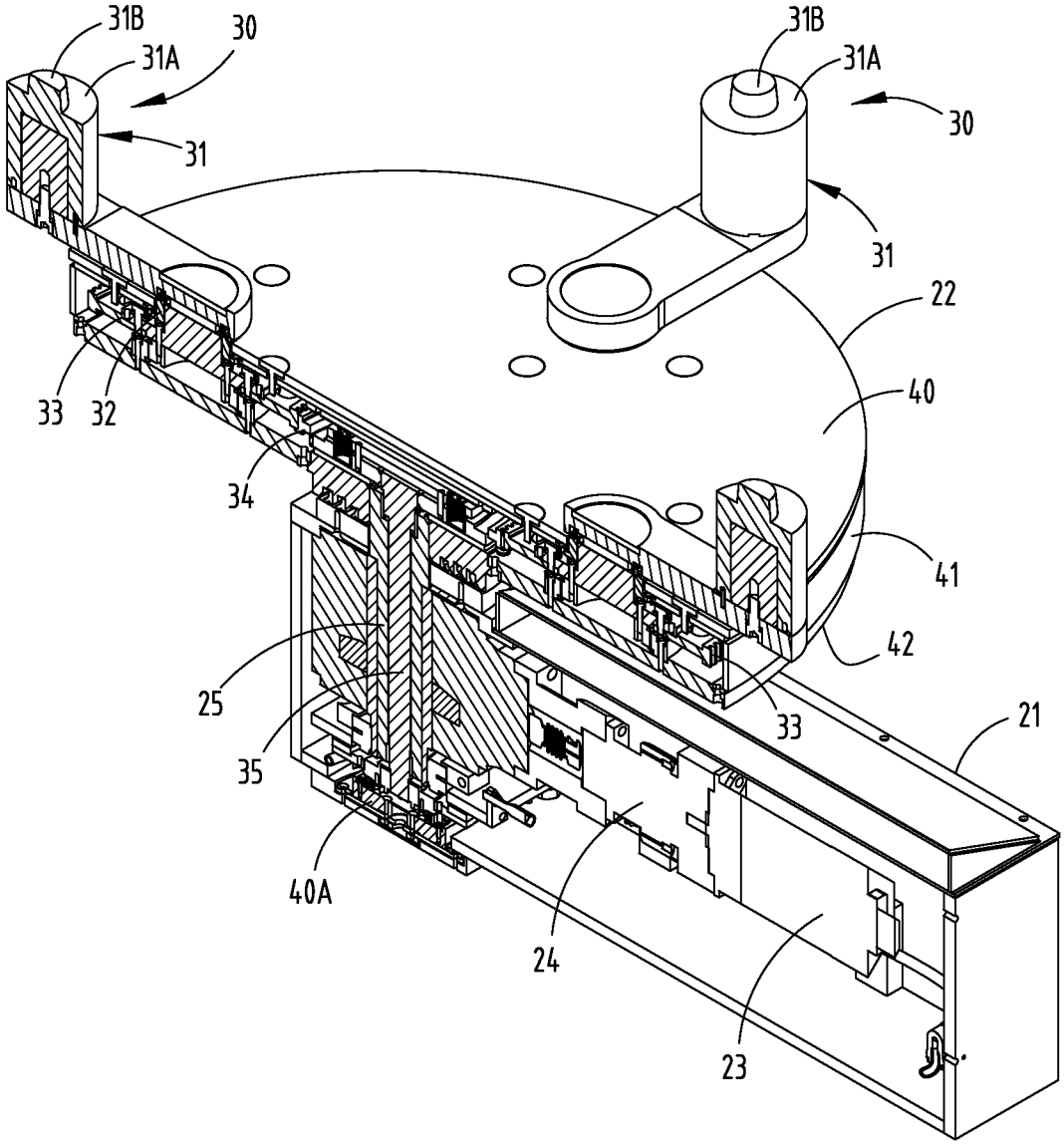
FIG. 7 is a cross sectional perspective view of FIG. 6.
Figure 7A:
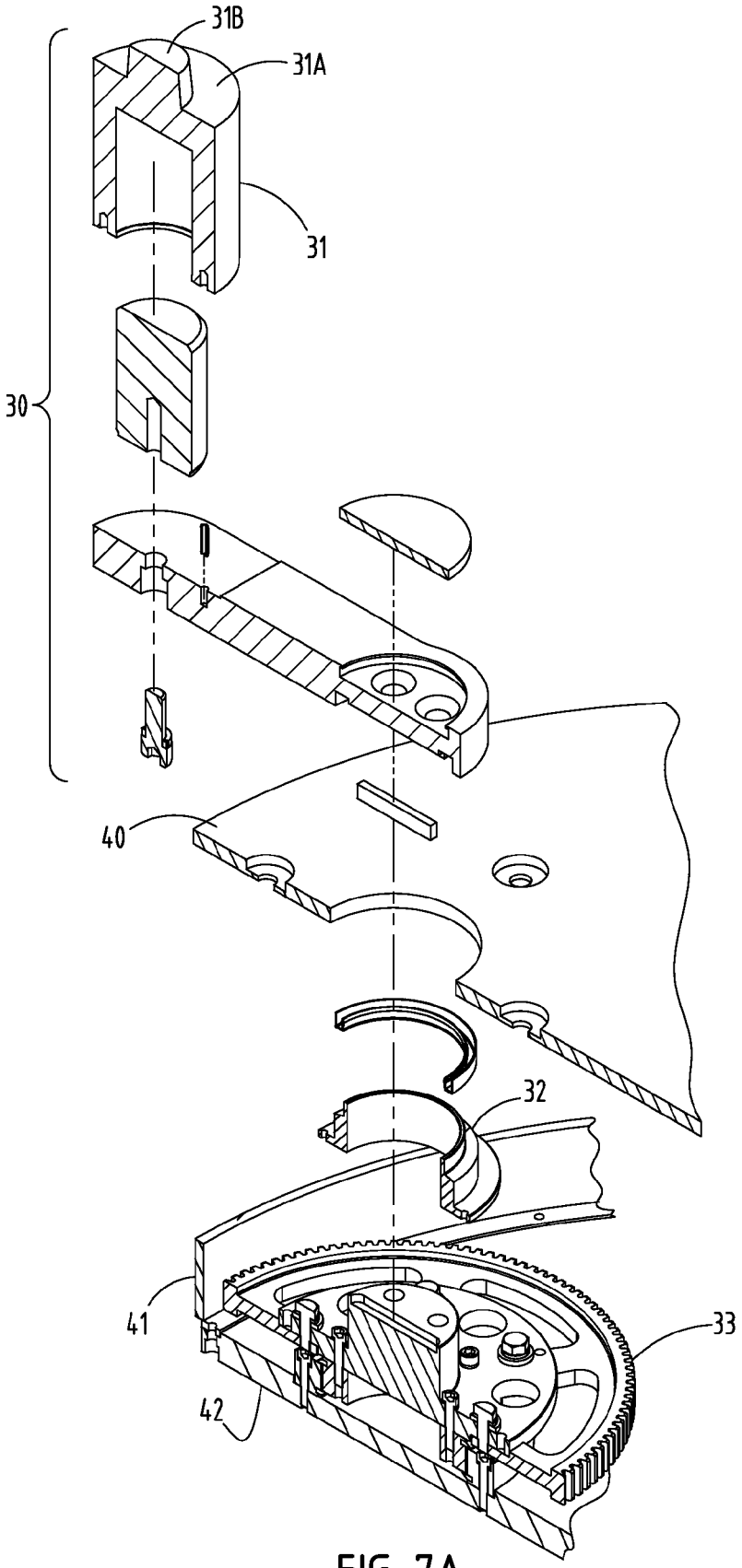
FIG. 7A is a fragmentary exploded view of FIG. 7.
Figure 8:
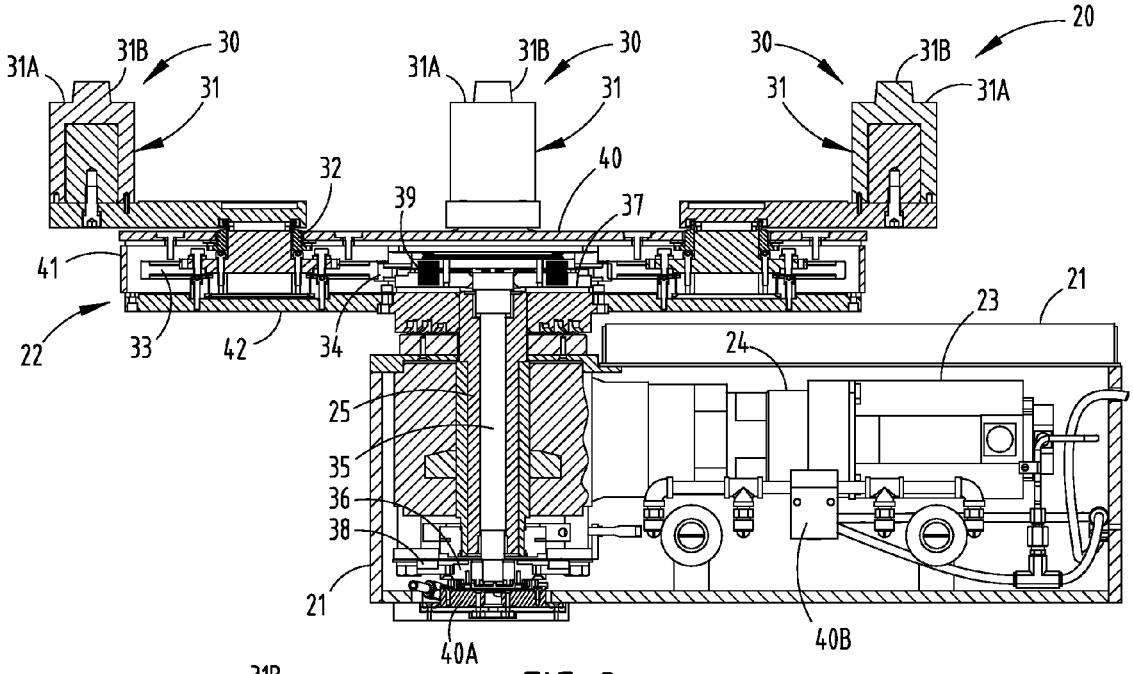
FIG. 8 is a side view similar to FIG. 1.
Figure 8A:
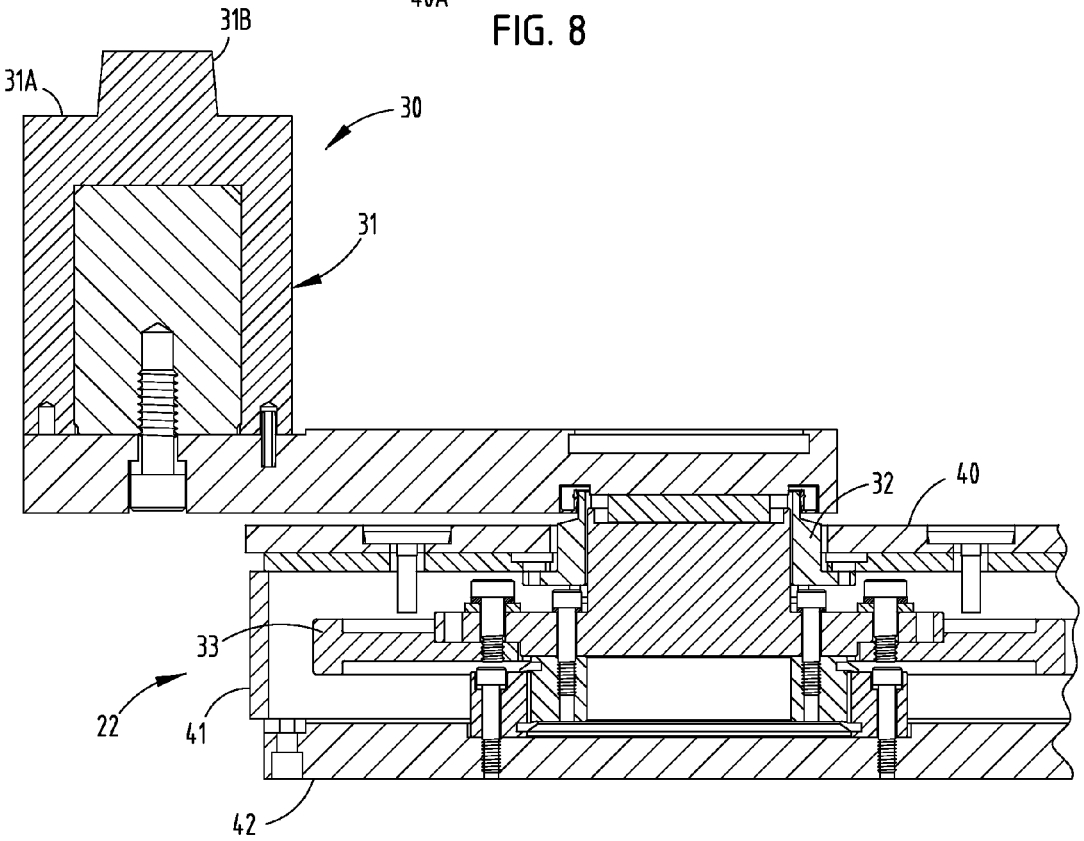
Figure 8B:
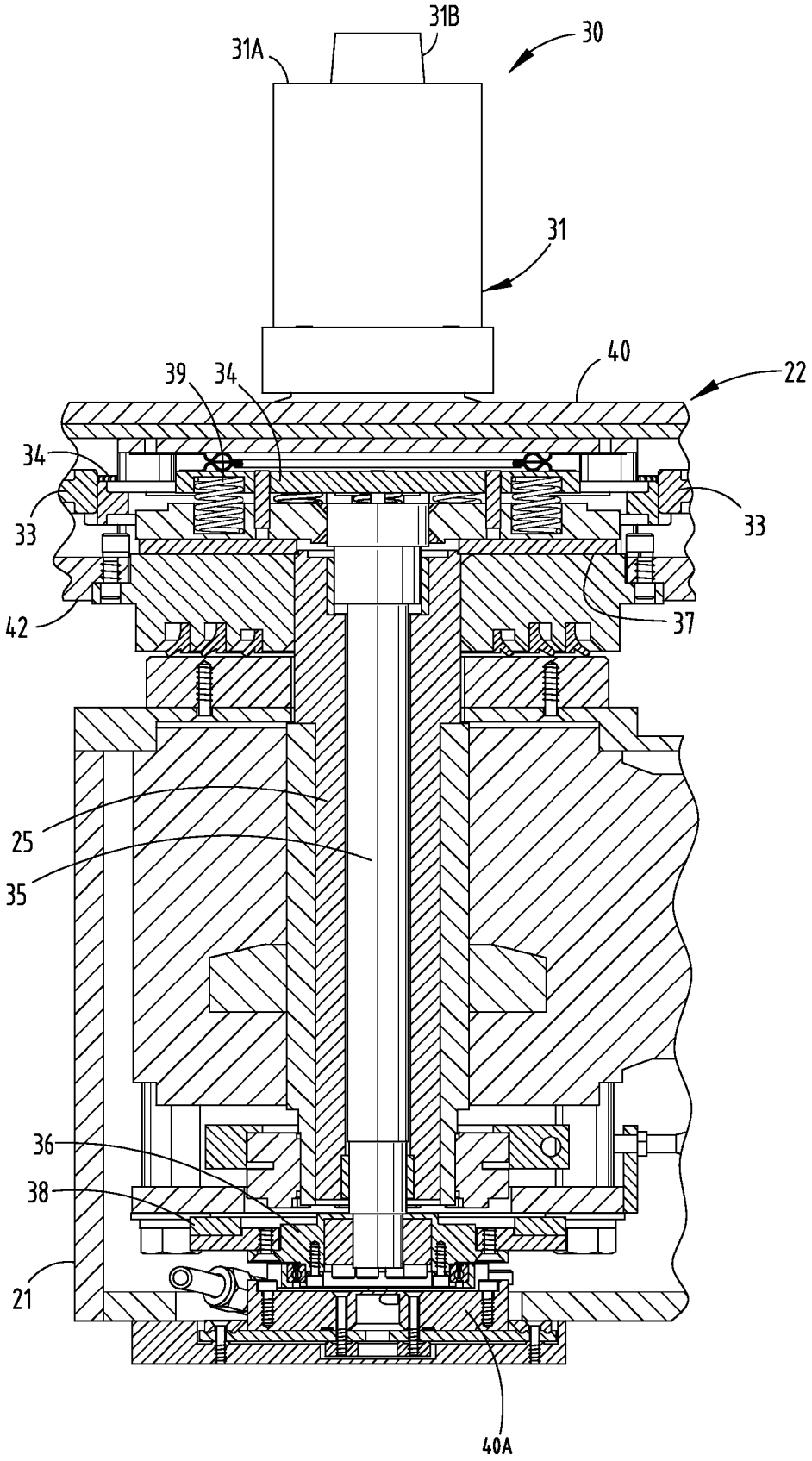
FIG. 8B is a fragmentary view similar to a center of FIG. 8 showing the table lifting and table rotating mechanism.

Specifically, the apparatus 20 (FIG. 4) includes a base housing 21 supporting a table 22 for rotation. The base housing 21 houses a servo motor 23 and gear box 24 operably connected to a (tubular/sleeve) primary drive shaft 25 to rotate the table 22 (and part 19) during the surface treatment operation. The table 22 includes a table top housing cover 40 and a table housing 41 with table housing base 42 under the table top 40. A plurality of arm assemblies 30 are pivotally supported in the cavity of the table 22 and extend upwardly and then laterally where they support part rest posts 31 over the table top 40. The arm assemblies 30 are pivotally supported in the cavity by pivot hubs 32 connected to bottom planetary gears 33. A center gear 34 is connected to the planetary gears 33. Springs 39 bias the center gear 34 against a top friction pad 37 on the table housing 41. The outer ends of the arm assemblies 30 (FIG. 8B) have a holder 31B that is shaped to securely engage the part 19 (regardless of the arm's position, see FIGS. 1A and 2A), such as by the holder being cylindrically or frusto-conically shaped.

The top friction pad 37 (FIG. 8B) prevents relative rotation between the center gear 34 and the table top 40 when the table 22 is rotating during normal surface treatment operation due to friction between pad 37 and the table base 42. An internal shaft 35 extends from a lower hub 36 through the tubular primary drive shaft 25 to the center gear 34. A pancake cylinder 40A (also called a "lift mechanism" herein) engages a bottom of the internal drive shaft 35. The pancake cylinder 40A can be operated to raise the internal shaft 35 from its normal down position to a raised adjustment-permitting position. When raised, this causes the lower hub 36 to engage the lower friction pad 38 and fix the internal drive shaft 35 to the base housing 21, and causes the center gear 34 to release from the top friction pad 37. Thus, when raised, the center gear 34 remains stationary while the table 22 is rotated, causing the arm assemblies 30 to rotatably move to new positions. Since the arm assemblies 30 rotate at locations spaced from a center of the table 22, the arm assemblies 30 simultaneously move the part rest posts 31 (and ends with part holders 31B) closer together (or farther apart) depending on rotation of the table 22. Once adjusted to their new position, the part rest posts 31 are configured to support a larger diameter part 19 or a smaller diameter part 19A (or any circular part within the range of adjustment of the apparatus 20.

In the present apparatus 20, the part rest posts 31 can be adjusted along paths 49 (FIG. 3) to support a part having a range of diameters between 4 inches to about 33 inches. It is noted that the present part rest posts 31 (FIG. 4) provide a horizontal resting surface 31A for supporting a part and also include the holder 31B (also called a "vertical nub" or frustoconical protrusion) for abutting a side of the part, such that a supported part is held in a fixed position, but so that the surfaces of the part are exposed for abrasive treatment. Notably, the illustrated apparatus with part rest posts 31 doesn't forcibly clamp a part, but instead is a locating/holding fixture where parts are securely and accurately held on it by gravity or other means. The illustrated part rest posts 31 are particularly well suited for holding wheels and cylindrical parts of different diameters. Nonetheless, it is contemplated that a variety of different variations can be made using the present technology, and a scope of the present invention is believed to encompass these variations. Further, even though the illustrated design works by not clamping the part, it is contemplated that the arms and apparatus could be designed that would clamp/secure the part, such as by providing a different robotic loading and/or providing a different end on the arm assemblies.

The present apparatus 20 (FIGS. 1 and 8B) provides four part rest posts 31 (though more or less could be used) that are mounted on the ends of arm assemblies 30 (also called "arms" or "part holding components") whose rotation hubs 32 protrude up through the spindle table surface. (Notably, it is contemplated that the arms could extend around a perimeter of the table up onto the table surface.) The arm assemblies 30 are spaced above the table top surface, such as a ¼ inch or the like, such that debris and abrasive/treatment material does not collect under them nor affect their adjustment nor adversely affect operation of apparatus 20. The hubs 32 are sealed to prevent abrasive material from entering bearings supporting the hubs 32 for rotational adjustment. The illustrated arm assemblies 30 are adjustable through 180 degrees of rotation such that the arm assemblies 30 adjust the four part rest posts 31 to retain cylindrical parts from about 4 inches to about 33 inches. The rotation is actuated by a center gear 34 inside the table top that drives a planetary gear 33 on each hub 32. As noted above, the center gear 34 is normally locked by springs 39 holding the center gear 34 against a friction surface on a top friction pad 37, meaning the arm assemblies 30 and four part rest posts 31 are normally rigid relative to the table 22.

In operation, when arm adjustment mode is required, the pancake cylinder 40A lifts the central shaft 35 just enough upward to both disengage the central gear from the upper friction pad 37 (releasing it from the table 22) and to engage the lower hub 36 with the lower friction pad 38 (fixing it to the base housing 21). This holds the central shaft 35 and center gear 34 stationary when the table 22 is rotated. By operation of the drive mechanism (servo motor 23 and gear box 24 and drive shaft 25), the table 22 rotates, but the arm assemblies 30 also rotationally adjust to new positions relative to a center point on the table 22. The arm assembly hubs 32 are sealed to prevent intrusion of abrasive media into bearings supporting the hubs 32. The rotational movement of the table 22 in the illustrated apparatus 20 is controlled by a controller 50 programmed with an algorithm and operably connected to the pneumatic control circuit 40B so that the arm assemblies 30 adjust to desired locations. In other words, as the arm assemblies 30 rotate with planetary gears 33 about the center gear 34, a specific arm angle is reached, and thereby the desired fixture setting for a part diameter is achieved. Once adjusted, the pancake cylinder 40A is retracted, causing the lower brake to release and the upper brake to re-engage, thus locking the arm assemblies 30 in their adjusted positions. A solenoid-operated pneumatic valves in the pneumatic control circuit 40B is used for inputting and releasing compressed air for operating the pancake cylinder 40A.

A preferred way of accurately locating the arm assemblies 30 is to reset the location of the arm assemblies 30 at one end of the 180 degree travel before each new adjustment by stroking the arm assemblies 30 into a hard stop at one end of their adjustment, so that accuracy can be maintained despite accumulating slippage on the upper and lower friction pads 37 and 38 during use. This "overrun adjustment" event will cause the friction pad 38 to slip when the arms reach the hardstops at the accurate known position at the end of their range. Making the arm adjustment from this known position ensures a better accuracy of the newly adjusted arm position. It is contemplated that the accurate positioning of the arm assemblies 30 can also be accomplished by other means. Notably, a slip feature could also be used in an apparatus designed for clamping retention of parts.

It is to be understood that variations and modifications can be made on the aforementioned structure without departing from the concepts of the present invention, and further it is to be understood that such concepts are intended to be covered by the following claims unless these claims by their language expressly state otherwise.

The embodiments of the invention in which an exclusive property or privilege is claimed are defined as follows:

1. An apparatus for supporting differently sized objects while treating or inspecting a surface of a selected one of the objects, comprising:

a base;

a table rotatable on the base and having a top surface;

a plurality of arm assemblies extending above the top surface and extending laterally, the arm assemblies each having a holder adapted to support any one of the differently sized objects above the top surface;

an adjustment mechanism for adjusting the arm assemblies rotationally to change relative positions of the holders equal amounts relative to a center area on the table, such that the arm assemblies can be automatically adjusted to support any one of the differently sized objects without further change; and a drive connected to both the table and the arm assemblies, the drive having a selectable first position configured to adjust the arm assemblies between different relative positions on the table, and having a separate second position configured to hold the arm assemblies in a selected one of the different relative positions as the table is rotated.

2. The apparatus of claim 1, including a controller programmed to automatically control actuation of the adjustment mechanism.

3. The apparatus of claim 1, wherein the adjustment mechanism selectively engages and disengages the drive to cause adjustment of the arm assemblies to different locations on the table.

4. The apparatus of claim 1, wherein the adjustment mechanism includes a central gear and each arm assembly includes a planetary gear engaging the central gear, the drive including a power-driven device for rotating at least one of the planetary gears and the central gear to cause adjustment of the arm assemblies to adjust locations of the arm assemblies.

5. The apparatus of claim 1, including at least one friction pad that holds the arm assemblies in their final adjusted positions.

6. The apparatus of claim 5, including a lift mechanism to release engagement with at least one friction pad so that the arm assemblies can be adjusted.

7. The apparatus of claim 6, including an additional friction pad that engages when the lift mechanism is operated so that the rotation of the table causes the arm assemblies to adjust.

8. The apparatus of claim 1, wherein the lift mechanism includes a pancake cylinder.

9. The apparatus of claim 1, wherein the adjustment mechanism simultaneously adjusts the arm assemblies.

10. An apparatus for supporting differently sized objects while treating or inspecting a surface of a selected one of the objects, comprising:

a base;

a table rotatable on the base and having a top surface;

a tubular drive shaft for rotating the table;

a plurality of arm assemblies pivotally supported by hubs and extending above the top surface and extending laterally, the arm assemblies each having an end spaced horizontally from the associated hub and adapted to support any one of the differently sized objects above the top surface; and an adjustment mechanism for automatically rotatably adjusting the arm assemblies to change relative positions of the ends relative to a center area on the table, the adjustment mechanism including an internal shaft extending through the tubular drive shaft that, when operated, selectively causes rotational adjustment of the hubs and hence adjustment of the ends of the arm assemblies; and a drive connected to both the table and the arm assemblies, the internal shaft having a selectable first position configured to adjust the arm assemblies between different relative positions on the table, and having a separate second position configured to hold the arm assemblies in a selected one of the different relative positions as the table is rotated.

11. The apparatus of claim 10, wherein the ends are configured to secure the objects but not clampingly engage the objects.

12. An apparatus for supporting differently sized cylindrical objects while treating or inspecting a surface of a selected one of the objects, comprising:

an enclosure and a processing gun in the enclosure for one of treating or inspecting a surface of a selected one of the cylindrical objects;

a rotatable table;

a plurality of adjustable arm assemblies attached to the table and adapted to support any one of the differently sized objects above the top surface; and an adjustment mechanism including a programmed controller for automatically adjusting the arm assemblies on the table, such that the arm assemblies are automatically adjusted to support a next one of the differently sized objects a drive connected to both the table and the arm assemblies, the drive having a selectable first position configured to adjust the arm assemblies between different relative positions on the table, and having a separate second position configured to hold the arm assemblies in a selected one of the different relative positions as the table is rotated.

13. The apparatus of claim 12, including a lift mechanism to release a brake component permitting adjustment of the arm assemblies.

14. The apparatus of claim 12, including friction pads to retain the arm assemblies to the table during rotation of the table.

15. An apparatus for treating or inspecting parts, comprising:

a fixture having a rotatable table and at least two adjustable arms on the table;

a single drive mechanism; and an adjustment mechanism having a first position where the single drive mechanism is engaged to rotate the table and having a second position where the single drive mechanism adjusts the arms; and a single drive connected to both the table and the arm assemblies, the drive having a selectable first position configured to adjust the arm assemblies between different relative positions on the table, and having a separate second position configured to hold the arm assemblies in a selected one of the different relative positions as the table is rotated.

16. The apparatus defined in claim 15, wherein the adjustment mechanism includes a lift mechanism that lowers a part of the drive mechanism when in the first position and that raises the part when in the second position.

17. An apparatus for treating or inspecting parts, comprising:

a fixture having a movable table and at least two adjustable arms on the table, the arms having part-holding surfaces configured to securely hold a part while the part is one of treated or inspected;

a drive mechanism for moving the table; and an adjustment mechanism including a lift mechanism for releasing the arm assemblies for adjustment and a brake mechanism for holding the table while the arm assemblies are adjusted; and the drive mechanism being connected to both the table and the arm assemblies, the drive mechanism having a selectable first position configured to adjust the arm assemblies between different relative positions on the table, and having a separate second position configured to hold the arm assemblies in a selected one of the different relative positions as the table is rotated.

18. A method for supporting differently sized objects while treating or inspecting a surface of a selected one of the objects, the differently sized objects including a first part with first diameter and a second part with a different second diameter, comprising:

providing a base, a table rotatable on the base and having a top surface, and a drive for rotating the table;

providing on the table a plurality of arm assemblies extending above the top surface and extending laterally, the arm assemblies each being adapted to support any one of the differently sized objects above the top surface;

the drive being connected to both the table and the arm assemblies, the drive having a selectable first position configured to adjust the arm assemblies between different relative positions on the table, and having a separate second position configured to hold the arm assemblies in a selected one of the different relative positions as the table is rotated;

conducting an operation including one of treating or inspecting a surface of a first part and after the operation, removing the first part from the arm assemblies;

automatically simultaneously adjusting the arm assemblies by selectively engaging the drive to rotationally change positions of the arm assemblies relative to a center area on the table for supporting a second part as the table is rotated; and conducting the operation on a surface of the second part and after the operation, removing the second part from the arm assemblies.

19. An apparatus for supporting differently sized cylindrical objects while treating or inspecting a surface of a selected one of the objects, comprising:

an enclosure and a processing gun in the enclosure for one of treating or inspecting a surface of a selected one of the cylindrical objects;

a rotatable table;

a plurality of adjustable arm assemblies attached to the table and adapted to support any one of the differently sized objects above the top surface;

a drive mechanism for both rotating the table and separately for selectively adjusting the arm assemblies on the table; the drive mechanism including at least one friction pad configured to hold the arm assemblies in a selected adjusted position when the table is being rotated to treat a selected one cylindrical object;

a lift mechanism selectively operable to release engagement with the at least one friction pad so that the arm assemblies can be adjusted; and an additional friction pad configured to engage when the lift mechanism is operated so that the rotation of the table causes the arm assemblies to adjust.

20. The apparatus of claim 1, wherein the separate second position includes rotating the table as the arm assemblies are adjusted between the different relative positions.

21. The apparatus of claim 1, wherein the drive is located under the table.

22. The apparatus of claim 1, wherein the drive includes a vertically moveable drive shaft.

23. The apparatus of claim 21, including friction pads that engage the drive shaft when the drive shaft is in one of the first and second relative positions and that disengage when the drive shaft is in another of the first and second relative positions.

* * * * *